US008279150B2

(12) United States Patent
Kim et al.

(10) Patent No.: US 8,279,150 B2
(45) Date of Patent: Oct. 2, 2012

(54) METHOD AND APPARATUS FOR PROCESSING DATA OF LIQUID CRYSTAL DISPLAY

(75) Inventors: Seong Gyun Kim, Gunpo-si (KR); Sun Woo Kwag, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 1134 days.

(21) Appl. No.: 11/475,740

(22) Filed: Jun. 26, 2006

(65) Prior Publication Data

US 2007/0001960 A1 Jan. 4, 2007

(30) Foreign Application Priority Data

Jun. 30, 2005 (KR) ..... 10-2005-0057955

(51) Int. Cl.
*G09G 3/36* (2006.01)

(52) U.S. Cl. ..... 345/92; 345/214

(58) Field of Classification Search ..... 345/90, 345/92–93, 99, 214–215, 102
See application file for complete search history.

(56) References Cited

U.S. PATENT DOCUMENTS 6,300,926 B1 * 10/2001 Yoneya et al. ..... 345/87
6,489,941 B1 * 12/2002 Inage et al. ..... 345/98
6,583,841 B2 * 6/2003 Youn et al. ..... 349/141
6,756,954 B2 * 6/2004 Yamamoto et al. ..... 345/87
7,251,009 B2 * 7/2007 Hayata et al. ..... 349/149
7,382,431 B2 * 6/2008 Lee ..... 349/141
7,522,134 B2 * 4/2009 Mizumaki ..... 345/87
2004/0246242 A1 * 12/2004 Sasaki ..... 345/204

FOREIGN PATENT DOCUMENTS

JP 2001-331156 11/2001
JP 2004-062134 2/2004
JP 2005-134864 5/2005
JP 2005134864 A * 5/2005
KR 1020010039664 A 5/2001
KR 1020010091912 A 10/2001

OTHER PUBLICATIONS

Action issued in corresponding Japanese Patent Application No. 2006-178273; issued May 19, 2009.

* cited by examiner

*Primary Examiner* — Joe H Cheng
(74) *Attorney, Agent, or Firm* — Brinks Hofer Gilson & Lion

(57) ABSTRACT

A method of driving and a liquid crystal display that are adaptive for preventing a motion blur phenomenon inserting a black data without reducing a data charging time are disclosed.

In the liquid crystal display, a first gate line supplies a first scanning signal. A second gate line supplies a second scanning signal. A data line supplies a data signal. A common line supplies a common voltage. A first thin film transistor supplies the data signal in response to the first scanning signal. In a liquid crystal cell, a pixel electrode is connected to the first thin film transistor and a common electrode is connected to the common line. A second thin film transistor supplies the common voltage to the pixel electrode in response to the second scanning signal.

12 Claims, 3 Drawing Sheets

METHOD AND APPARATUS FOR PROCESSING DATA OF LIQUID CRYSTAL DISPLAY

This application claims the benefit of Korean Patent Application No. P2005-0057955 filed in Korea on Jun. 30, 2005, which is hereby incorporated by reference.

BACKGROUND

1. Field of the Invention

This invention relates to a liquid crystal display, and more particularly to a liquid crystal display (LCD) and a method of driving the LCD that prevents a motion blur phenomenon.

2. Description of the Related Art

A liquid crystal display controls the light transmittance of a liquid crystal that has a dielectric anisotropy that uses an electric field, and thus displays a picture. The liquid crystal display includes a liquid crystal display panel having a pixel matrix and a drive circuit for driving the liquid crystal display panel.

As shown in FIG. 1, the liquid crystal display includes a liquid crystal display panel 10 having a pixel matrix, a gate driver 12 for driving a gate line GL of the liquid crystal display panel 10, a data driver 14 for driving a data line DL of the liquid crystal display panel 10, and a timing controller 16 for controlling the gate driver 12 and the data driver 14.

The liquid crystal display panel 10 includes a liquid crystal cell matrix having a liquid crystal formed at each area defined by the crossing of the gate line GL and the data line DL. Each of the liquid crystal cells includes a liquid crystal cell Clc which controls the light transmission amount in accordance with a data signal, and a thin film transistor TFT that drives the liquid crystal cell. The thin film transistor TFT allows a data signal applied to the data line DL to be charged in the liquid crystal cell Clc and be held in response to a scanning signal applied to the gate line GL. The liquid crystal cell Clc changes the state of the liquid crystal in accordance with the data signal and controls the light transmittance and thus realizes a gray level.

The gate driver 13 sequentially supplies the scan signal to the gate line GL in response to a control signal from the timing controller 16.

The data driver 14 converts digital data from the timing controller 16 into an analog data signal and supplies the signal to the data line DL.

The timing controller 16 supplies a control signal which controls the gate driver 12 and the data driver 14, and supplies the digital data to the data driver 14.

The liquid crystal display provided with the thin film transistor at each liquid crystal cell is an active matrix type. Thus, the active matrix provides an image to the display. However, because of a slow response speed caused by the characteristics of the liquid crystal such as inherent viscosity, elasticity, and hold type driving characteristics, a motion blur phenomenon is generated by a residual image of a former frame.

To solve the motion blur phenomenon, the related art liquid crystal display uses a driving method that inserts black data. A method of inserting the black data is employed such that the black frame is inserted between the frames by raising the frame frequency or the image data and the black data are classified and applied by dividing one horizontal period charging the image data. However, the method of inserting black data reduces charging time of the image data when the frame frequency is increased or the horizontal period charging the image data is divided into smaller periods.

Accordingly, in the related art method of inserting the black data, a data charging time is reduced in a large size liquid crystal display.

SUMMARY

A liquid crystal display is provided that includes a first gate line that supplies a first scanning signal. A second gate line supplies a second scanning signal. A data line supplies a data signal. A common line supplies a common voltage. A first thin film transistor supplies the data signal in response to the first scanning signal. A liquid crystal cell includes a pixel electrode connected to the first thin film transistor and a common electrode connected to the common line. A second thin film transistor supplies the common voltage to the pixel electrode in response to the second scanning signal.

A liquid crystal display according to another embodiment of the present invention is comprised of an image display including a plurality of first gate lines that supply a first scanning signal. A plurality of second gate lines supply a second scanning signal. A plurality of data lines supply a data signal. A plurality of common lines supply a common voltage. A pixel electrode is provided for each pixel area defined by an intersection between the first and second gate line and the data line. A liquid crystal cell includes a common electrode connected to the common line. A first thin film transistor supplies the data signal to the pixel electrode in response to the first scanning signal. A second thin film transistor supplies the common voltage to the pixel electrode in response to the second scanning signal. A first gate driver supplies a plurality of first scanning signals to a plurality of the first gate lines. A second gate driver supplies a plurality of second scanning signals to a plurality of the second gate lines. A data driver drives the data signal to a plurality of the data line. A common voltage generator supplies a plurality of the common lines with a common voltage.

A method of driving a liquid crystal display according to an embodiment of the present invention includes supplying a data signal of a data line to a pixel electrode of a liquid crystal cell by a first thin film transistor connected to a first gate line. A common signal of a common line is supplied to the pixel electrode by a second thin film transistor connected to a second gate line.

BRIEF DESCRIPTION OF THE DRAWINGS

These and other objects of the invention will be apparent from the following detailed description of the embodiments of the present invention with reference to the accompanying drawings, in which.

DETAILED DESCRIPTION

The preferred embodiments of the present invention will be described in detail with reference to FIG. 2 to FIG. 3.

Figure 1:
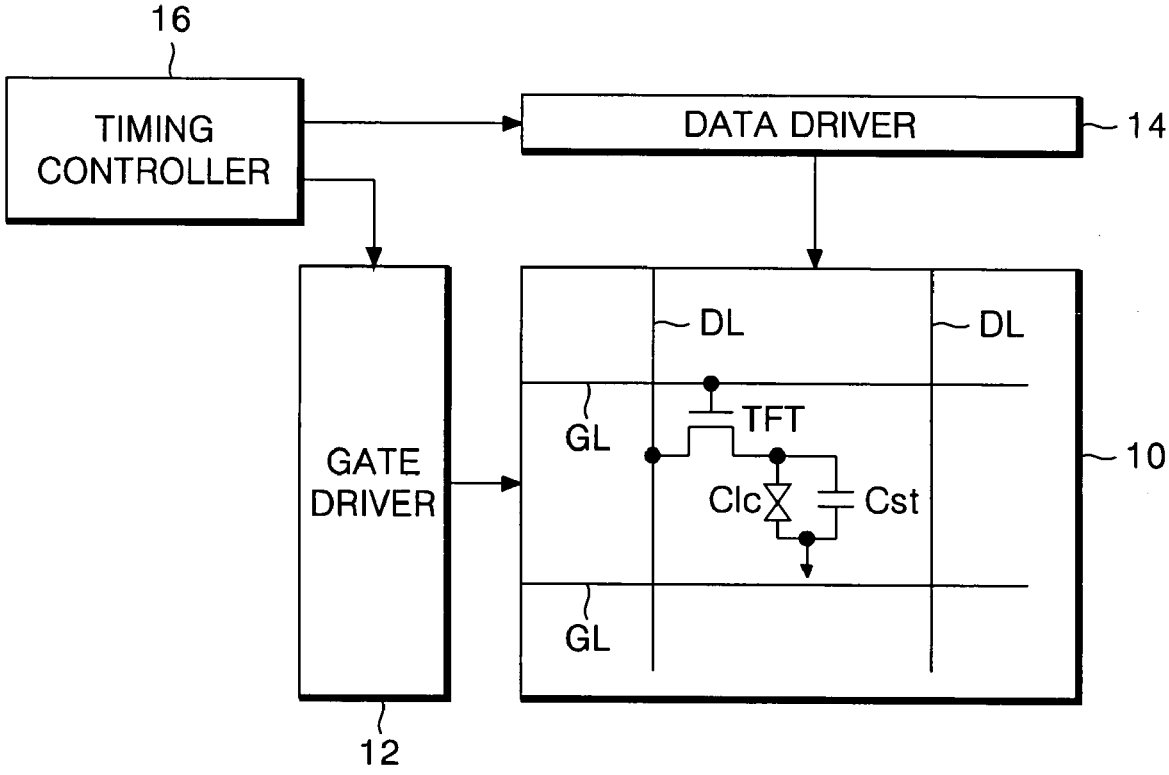
FIG. 1 RELATED ART
FIG. 1 is a diagram illustrating a related art liquid crystal display.
Figure 2:
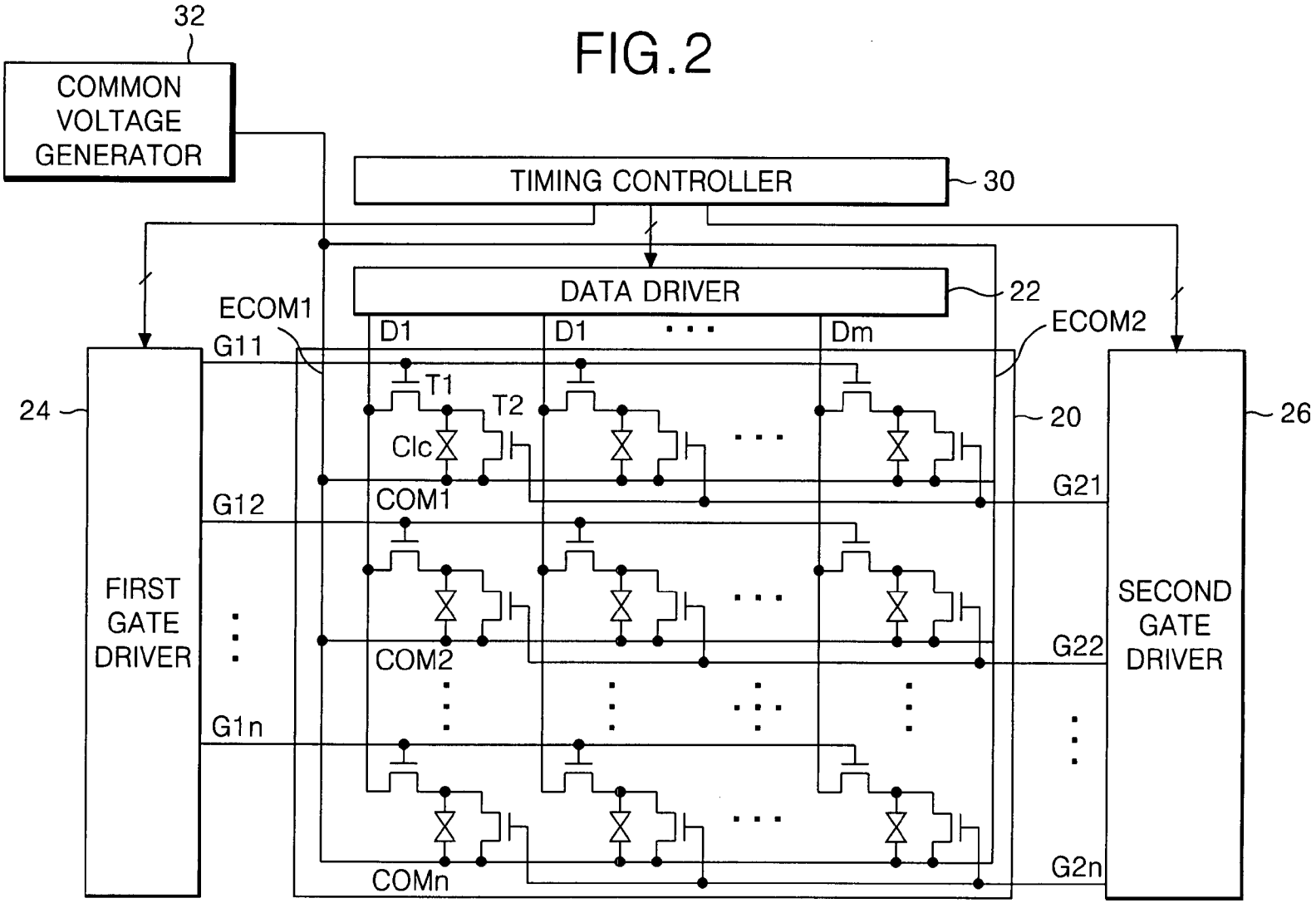
FIG. 2 is a diagram illustrating a liquid crystal display according to an embodiment of the present invention.

FIG. 2 illustrates a liquid crystal display according to an embodiment of the present invention. FIG. 3 illustrates a driving waveform of the liquid crystal display shown in FIG. 2.

As seen in FIG. 2, a liquid crystal display includes an image display 20 having a liquid crystal cell matrix, a data driver 22 for driving data lines D1~Dm, a first gate driver 24 for driving gate lines G11~G1*n* of a first group, a second gate driver 26 for driving gate lines G21~G2*n* of a second group, a timing controller 30 for controlling a data driver 22 and a first and second gate driver 24 and 26, a common voltage generator 32 for driving a common line COM1~COMn of an image display 20.

A timing controller 30 aligns image data inputted from outside and supplies a signal to a data driver 22. In a timing controller 30, a plurality of source controlling signals and gate controlling signals are generated by, for example, a data enable signal, a horizontal synchronous signal, a vertical synchronous signal informing an effect data interval inputted from outside, and a clock signal that is determined by timing of a data. The source controlling signals supply signals to a data driver 22 and first and second gate drivers 24 and 26.

A data driver 22 converts digital image data inputted by the source controlling signals and a plurality of gamma voltage signals inputted from a gamma voltage generator, into an analog image data signal. The data driver supplies the converted analog image data signal to data lines D1~Dm of an image display 20. A data driver 22 supplies an image data signal to data lines D1~Dm whenever a first scanning signal is supplied to each gate line G11~G1*n* of a first group, as shown in FIG. 3.

A first gate driver 24 supplies a scanning signal that drives sequentially gate lines G11~GL1*n* of a first group, using a gate controlling signal from a timing controller 30. Specifically, a first gate driver 24 shifts a first gate starting pulse from a timing controller 30 according to a gate shifting clock in each frame, thereby generating a first scanning signal that drives sequentially a gate line G11~GL1*n* of a first group shown in FIG. 3.

A second gate driver 26 supplies a scanning signal that drives sequentially gate lines G21~GL2*n* of a second group, using a gate controlling signal from a timing controller 30. Specifically, a second gate driver 26 shifts a second gate starting pulse from a timing controller 30 according to a gate shifting clock in each frame, thereby generating a second scanning signal that drives sequentially gate lines G21~GL2*n* of a second group shown in FIG. 3.

Data lines D1~Dm connected to a data driver 22 intersect with gate lines G11~Gln of a first group connected to a first gate driver 24 and gate lines G21~G2*n* of a second group connected to a second gate driver 26, and common lines COM1~COMn. Each gate line G11~G1*n* of a first group is alternatively provided with each gate line G21~G2*n* of a second group, respectively. Each common line COM1~COMn is formed between each gate line G11~G1*n* of a first group and each gate line G21~G2*n* of a second group, respectively. Each common line COM1~COMn is supplied a common voltage from a common voltage generator 32, via an external common line ECOM crossed with gate lines G11~G1*n* and G21~G2*n* outside of an image display 20.

A liquid crystal cell is formed at each pixel area defined by an intersection structure of gate lines G11~G1*n* and G21~G2*n* and data line D1~Dm. A liquid crystal cell includes a liquid capacitor Clc, a first thin film transistor T1 that supplies an image data signal to a liquid crystal cell Clc, and a second thin film transistor T2 that supplies a common voltage Vcom, used as a black data signal.

A liquid crystal cell Clc includes a pixel electrode connected to a first thin film transistor T1 to apply an electric field to a liquid crystal, and a common electrode connected to any one of common lines COM1~COMn. A first thin film transistor supplies an image data signal from any one of data lines D1~Dm in response to a first scanning signal from any one of gate lines G11~G1*n* of a first group to a pixel electrode of a liquid crystal cell Clc. A liquid crystal having a dielectric anisotropy is rotated by an electric field provided at a liquid crystal cell Clc with a difference between a data signal supplied to a pixel electrode and a common voltage Vcom supplied to a common electrode, thereby controlling light transmittance. A liquid crystal cell further includes a storage capacitor Cst connected in parallel with a liquid crystal cell Clc to keep a voltage charged into a liquid crystal cell Clc whenever a first thin film transistor T1 is turned-off.

A second thin film transistor T2 is connected to any one gate line of gate lines G21~G2*n* of a second group, any one common line of common lines COM1~COMn, and a pixel electrode of a liquid crystal cell Clc. The second thin film transistor T2 supplies a common voltage from any one common line in response to a second scanning signal from any one gate line of gate lines G21~G2*n* of a second group instead of a black data signal to a pixel electrode of a liquid crystal cell Clc. A liquid crystal display panel using an IPS (In Plane Switching) and a FFS (Fringe Field Switching) liquid crystal type in a normally black mode makes it possible to provide a common voltage Vcom instead of black data.

Accordingly, an image display 20 supplies, via a first thin film transistor T1, an image data signal to a liquid crystal cell Clc and holds the image data signal. An image display 20 supplies, via a second thin film transistor T2, a common voltage Vcom to a liquid crystal cell Clc. It then becomes possible to supply a common electrode Vcom instead of black data to a liquid crystal cell Clc. Thus, the data charging time is not reduced because of a first thin film transistor T1.

Figure 3:
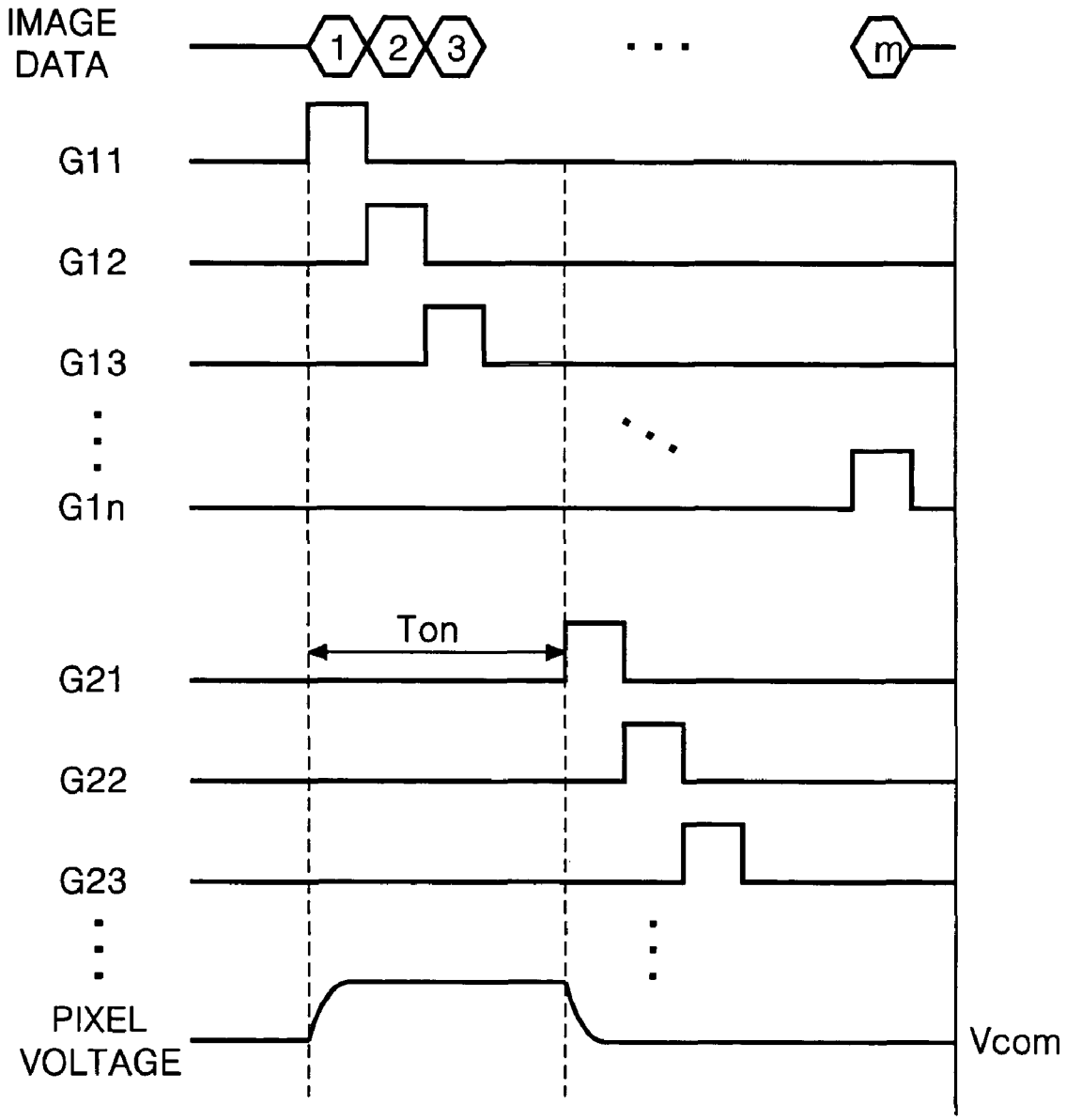
FIG. 3 is a driving waveform diagram of the liquid crystal display shown in FIG. 2.

For example, referring to FIG. 3, gate lines G11~G1*n* of a first group are sequentially driven in response to a first scanning signal from a first gate driver 24. A first thin film transistor T1 is sequentially turned-on in response to a first scanning signal, the image data signal is then supplied from data lines D1~Dm to a pixel electrode. Accordingly, a pixel voltage corresponding to a voltage difference between an image data signal and a common voltage is charged into the pixel electrode and held in a liquid crystal cell Clc, thereby displaying a gray scale corresponding to a pixel voltage.

Gate lines G11~G1*n* of a first group are sequentially driven by the first gate driver. As a designated time goes by, gate lines G21~G2*n* of a second group are sequentially driven in response to a second scanning signal from a second gate driver 26. A second thin film transistor T2 is sequentially turned-on in response to a second scanning signal and supplies a common voltage Vcom to a pixel electrode, so that a liquid crystal cell Clc displays a black gray scale level.

A pixel voltage charged into a liquid crystal cell Clc through a first thin film transistor T1 is held, so that a period Ton displaying a designated gray scale level can be changed by a point of driving a second thin film transistor T2. Accordingly, a period Ton displaying a designated gray scale level in each frame can be controlled by an average brightness of a frame. For example, when a high average brightness image such as a motion picture is displayed, a period Ton displaying a designated gray scale level is increased. On the other hand, while a low average brightness image such as a darkness image is displayed, a period Ton displaying a designated gray scale level is decreased. Such gray scale level display period can be changed by controlling a point of driving a second thin film transistor T2 according to the average brightness, for example, a point of supplying a gate starting pulse to a second gate driver 26.

As described above, according to the present invention, the addition of a second thin film transistor and a common voltage instead of black data, thus prevents a motion blur phenomenon without reducing a charging time of an image data signal through a first thin film transistor. Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display, comprising:

a first gate lines of a first group that supplies a first scanning signal;

a second gate lines of a second group that supplies a second scanning signal;

a data line that supplies a data signal;

first and second external common lines crossed with the first gate lines and the second gate lines outside of an image display;

a plurality of common lines that supplies a common voltage provided by the external common line;

a first thin film transistor that supplies the data signal in response to the first scanning signal;

a liquid crystal cell including a pixel electrode connected to the first thin film transistor and a common electrode connected to the common line; and a second thin film transistor that supplies the common voltage to the pixel electrode in response to the second scanning signal, instead of black data, and the second thin film transistor is connected to any one gate line of second gate lines of the second group, any one common line of common lines, and a pixel electrode of the liquid crystal cell, wherein each first gate line of the first group is alternatively formed with each second gate line of the second group, respectively, wherein the second gate lines of the second group are sequentially driven by the second scanning signal, after the first gate lines of the first group are sequentially driven by the first scanning signal, wherein the first scanning signal is generated by shifting a first gate starting pulse from a timing controller according to a gate shifting clock in each frame, and the second scanning signal is generated by shifting a second gate starting pulse from the timing controller according to the gate shifting clock in each frame, wherein each common line is formed between each first gate line of the first group and each second gate line of the second group and connected to the first and second external common lines, wherein the second thin film transistor supplies the pixel electrode with the common voltage, after said first thin film transistor allows the data signal to be charged in the pixel electrode and be held, wherein a period of keeping the data signal charged in the pixel electrode by the first thin film transistor is changed by a turning-on time of the second thin film transistor.

2. The liquid crystal display as claimed in claim 1, wherein the period of keeping the data signal charged in the pixel electrode is changed by controlling a point of driving the second thin film transistor according to an average brightness of a frame.

3. The liquid crystal display as claimed in claim 2, wherein the period of keeping the data signal charged in the pixel electrode is changed in each frame.

4. A liquid crystal display, comprising:

an image display including a plurality of first gate lines that supply a first scanning signal;

a plurality of second gate lines that supply a second scanning signal;

a plurality of data lines that supply a data signal;

a plurality of common lines that supply a common voltage;

a pixel electrode provided for each pixel area defined by an intersection between the first and second gate line and the data line;

a liquid crystal cell including a common electrode connected to the common line;

a first thin film transistor that supplies the data signal to the pixel electrode in response to the first scanning signal, and a second thin film transistor that supplies the common voltage to the pixel electrode in response to the second scanning signal, instead of black data;

first and second external common lines crossed with the first gate lines and the second gate lines outside of the image display and connected to the plurality of common lines;

a first gate driver that supplies a plurality of the first scanning signal to a plurality of the first gate lines;

a second gate driver that supplies a plurality of the second scanning signal to a plurality of the second gate lines;

a data driver that drives the data signal to a plurality of the data line; and a common voltage generator for providing the common voltage to the plurality of the common lines via an external common line crossed with the first and second gate lines outside of the image display, wherein the second thin film transistor is connected to any one gate line of second gate lines of the second group, any one common line of common lines, and a pixel electrode of the liquid crystal cell, wherein the second thin film transistor supplies the pixel electrode with the common voltage, after said first thin film transistor allows the data signal to be charged in the pixel electrode and be held, wherein each first gate line is alternatively formed with each second gate, respectively, wherein the first gate driver shifts a first gate starting pulse from a timing controller according to a gate shifting clock in each frame, and generates the first scanning signal, wherein the second gate driver shifts a second gate starting pulse from the timing controller according to the gate shifting clock in each frame, and generates the second scanning signal, wherein the second gate lines are sequentially driven by the second scanning signal, after the first gate lines are sequentially driven by the first scanning signal, wherein each common line is formed between each first gate line and each second gate line, wherein a period of keeping the data signal charged in the pixel electrode by the first thin film transistor is changed by a turning-on time of the second thin film transistor.

5. The liquid crystal display as claimed in claim 4, wherein said second gate driver, if the first thin film transistor allows the data signal to be charged in to the pixel electrode and to be kept for a designated period, supplies the second scanning signal to the second thin film transistor.

6. The liquid crystal display as claimed in claim 5, wherein said second gate driver controls a period that a data signal is charged into the pixel electrode by changing a point that the second scanning signal is applied.

7. The liquid crystal display as claimed in claim 6, wherein said second gate driver changes a point of supplying of the second scanning signal in response to an inputted control signal according to an average brightness from outside the display.

8. The liquid crystal display as claimed in claim 6, wherein said second gate driver changes the point of supplying the second scanning signal in each frame.

9. A method of driving a liquid crystal display, comprising the steps of:

generating a first gate starting pulse and a second gate starting pulse;

generating a first scan signal for driving a first gate line of a first group formed on an image display by shifting the first gate starting pulse according to a gate shifting clock in each frame, and a second scan signal for driving a second gate line of a second group formed on an image display by shifting a second gate starting pulse from a timing controller according to the gate shifting clock in each frame;

generating a common voltage for driving a common line formed between the first gate line of the first group and the second gate line of the second group;

supplying the common voltage to the common line via an external common line crossed with the first and second gate lines outside of the image display;

supplying a data signal of a data line to a pixel electrode of a liquid crystal cell by a first thin film transistor connected to the first gate line of the first group;

supplying the common voltage of the common line to the pixel electrode, instead of black data, by a second thin film transistor connected to the second gate line of the second group, wherein the second thin film transistor is connected to any one gate line of second gate lines of the second group, any one common line of common lines, and a pixel electrode of the liquid crystal cell, wherein if the first thin film transistor allows the data signal to be charged into the pixel electrode and to be held for a designated period, then the second thin film transistor supplies the common voltage, wherein each first gate line of the first group is alternatively formed with each second gate line of the second group, respectively, wherein the second gate lines of the second group are sequentially driven by the second scanning signal, after the first gate lines of the first group are sequentially driven by the first scanning signal, wherein a period of keeping the data signal charged in the pixel electrode by the first thin film transistor is changed by a turning-on time of the second thin film transistor.

10. The method as claimed in claim 9, wherein said second thin film transistor changes a point of supplying the common voltage, to thereby change a period of keeping a data signal charged into the pixel electrode.

11. The method as claimed in claim 10, wherein a point of supplying the common voltage changes in each frame in the second thin film transistor.

12. The method as claimed in claim 9, further comprising the step of:

detecting an average brightness of the data signal during a frame, and wherein the second thin film transistor according to the average brightness changes a point of supplying the common voltage.

* * * * *